US006334326B1

(12) United States Patent
Kang et al.

(10) Patent No.: US 6,334,326 B1
(45) Date of Patent: Jan. 1, 2002

(54) FIN TUBE TYPE EVAPORATOR IN AIR CONDITIONER

(75) Inventors: Sung Hee Kang, Chungchongnam-do; Sam Chul Ha, Kyongsangnam-do, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/585,445

(22) Filed: Jun. 2, 2000

(30) Foreign Application Priority Data

Jun. 3, 1999 (KR) ..... 99/20505

(51) Int. Cl.[7] ..... F25D 21/14

(52) U.S. Cl. ..... 62/290; 62/285; 62/515; 165/151

(58) Field of Search ..... 62/290, 285, 515; 165/151, 110, 181

(56) References Cited

U.S. PATENT DOCUMENTS 3,796,258 A * 3/1974 Malhortra et al. ..... 165/151
3,902,551 A * 9/1975 Lim et al. ..... 165/111
4,860,822 A * 8/1989 Sacke ..... 165/151
5,056,594 A * 10/1991 Kraay ..... 165/151
5,111,876 A * 5/1992 Nash ..... 165/151
5,241,839 A * 9/1993 Hughes ..... 62/515
5,514,248 A * 5/1996 Okuda et al. ..... 159/28.6
5,937,668 A * 8/1999 Jun ..... 62/290

* cited by examiner

*Primary Examiner*—Henry Bennett
*Assistant Examiner*—Melvin Jones
(74) *Attorney, Agent, or Firm*—Fleshner & Kim, LLP

(57) ABSTRACT

Fin tube type evaporator in an air conditioner including tubes for flow of a refrigerant therethrough, and fins each having a plurality of collars for coupling with the tubes, and a plurality of slits formed between the collars, wherein drain means of a predetermined form is formed between the collars, thereby draining the condensed water smoothly and reducing an air flow resistance, and leakage of condensed water out of the air conditioner.

18 Claims, 8 Drawing Sheets

FIN TUBE TYPE EVAPORATOR IN AIR CONDITIONER

BACKGROUND OF THE INVENTION

1. Field of the Invention

The present invention relates to an air conditioner, and more particularly, to a fin tube type evaporator in an air conditioner, for cooling down air by using a heat absorption action of an evaporating refrigerant.

2. Background of the Related Art

The evaporator used in the air conditioner is one kind of heat exchanger, in general of a fin-tube type, which is shown in FIGS. 1, 2A, and 2B, and with reference to which a related art fin tube type evaporator will be explained.

The related art fin tube type evaporator is provided with a plurality of fins 20 of metal plate, and tubes 10 passing through the fins 20 for flowing the refrigerant. That is, the plurality of fins 20 are arranged perpendicular to the tubes 10 at fixed intervals. FIG. 1 shows one of such fins 20 including the tubes 10. As shown in FIG. 1, there are a plurality of collars 22 fitted to a base plate 21 of the fins 20 along a long side direction of the fins 20 for coupling with the tubes 10. In general, the collars 22 are arranged in a zigzag form in two columns of a first column and a second column along a direction of advance of external air for improvement of a cooling efficiency. According to this, the tubes 20 are also arranged identical to the arrangement of the collars 22 perpendicular to the fins 20. And, there are a slit group including a plurality of slits between adjacent collars 22 in the same column for improving a heat exchange efficiency. As shown in FIG. 2, the slits 23 are formed as upper slits 23*a* and lower slits 23*b* alternatively with reference to the base plate 21. And, depending on conditions of use, a number, shape and arrangement of the slits 23 may be adjusted, for guiding an air flow and enhancing heat transfer. External air is introduced into the evaporator when the air conditioner is in operation, and cooled down by heat exchange, i.e., a heat absorption. The external air becomes turbulent by the slits during the external air passes through the evaporator, that enhances the heat exchange effect.

However, the related art evaporator in the air conditioner has a complex fin surface form due to the slits 23 such that water condensed from moist in the air during the heat exchange can not be drained with easy, but remained on the tube 10 or the fin 20 surface, which sharply increases flow resistance , that in turn increases a load on a blower in the air conditioner. And, a portion of which is blown out of the evaporator carried on the air flow.

SUMMARY OF THE INVENTION

Accordingly, the present invention is directed to a fin tube type evaporator in an air conditioner that substantially obviates one or more of the problems due to limitations and disadvantages of the related art.

An object of the present invention is to provide a fin tube type evaporator in an air conditioner, which can enhance draining capability of condensed water.

Another object of the present invention is to provide a fin tube type evaporator in an air conditioner, which can reduce an air flow resistance.

Other object of the present invention is to provide a fin tube type evaporator in an air conditioner, which can prevent the condensed water carried out of the evaporator.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the fin tube type evaporator in an air conditioner includes tubes for flow of a refrigerant therethrough, and fins each having a plurality of collars for coupling with the tubes, and a plurality of slits formed between the collars, wherein drain means of a predetermined form is formed between the collars.

The drain means is grooves each with fixed width and a fixed length having symmetric convex/concave sections.

The drain means may have a fixed width throughout the length of an entire drain means, but, preferably, have a width increased gradually along the length of the drain means, and, preferably, the length of the drain means is the same with a distance between adjacent collars in the fin.

The section of the drain means includes a pair of symmetric portions of one peak portion and a bottom portion, and preferably, includes a plurality of symmetric portions. And, the symmetric portion preferably has a height lower than a height of the slit, and the section of the symmetric portion is a circular arc, trapezoidal, triangular, or rectangular.

The fin tube type evaporator in an air conditioner of the present invention can improve a drain capability, reduce a flow resistance caused by remained condensed water, and prevent leakage of the condensed water out of the air conditioner.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
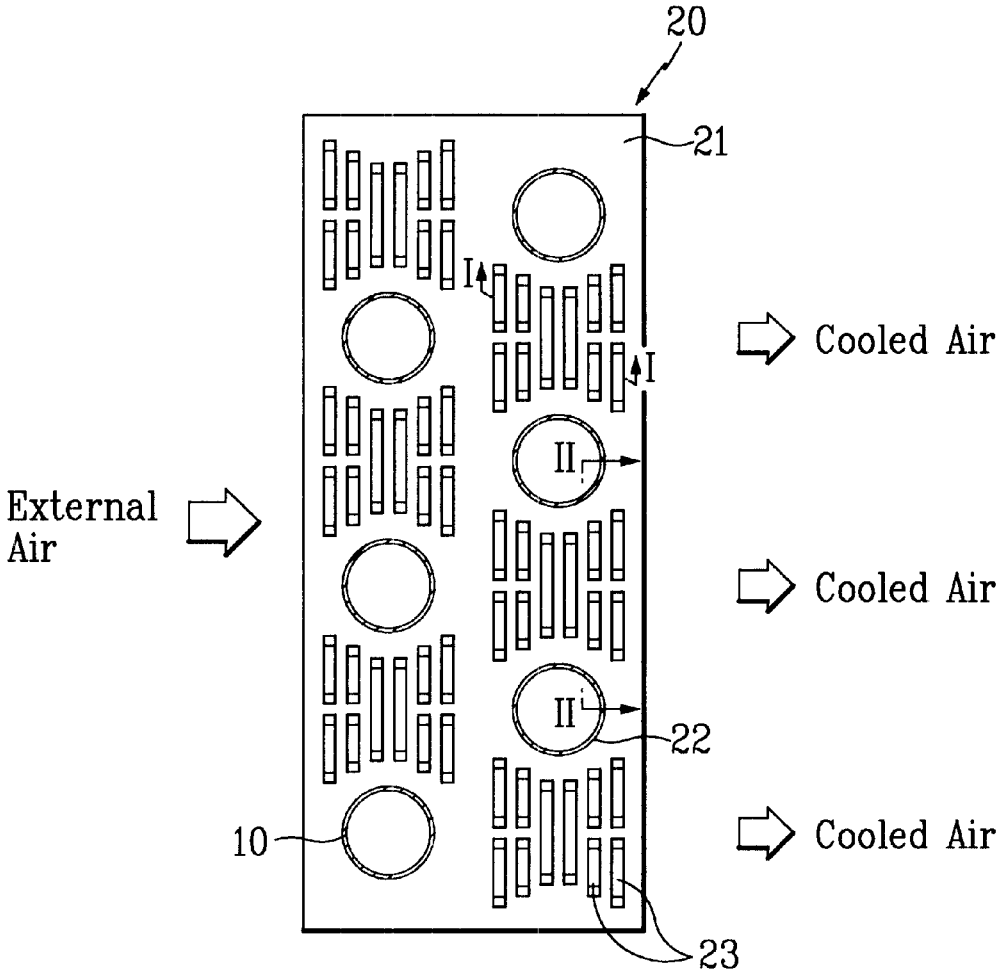
FIG.1 Related Art
FIG. 1 illustrates a section of a portion of a related art evaporator in an air conditioner.
Figure 2A:
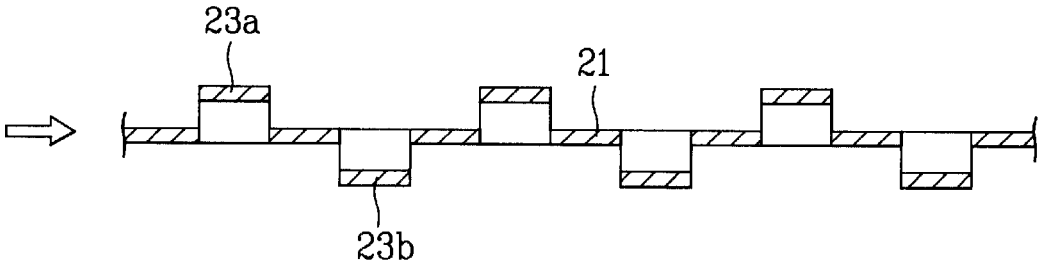
FIG.2A Related Art
FIGS. 2A and 2B illustrate sections across line I—I, and II—II in FIGS. 1, respectively.
Figure 2B:
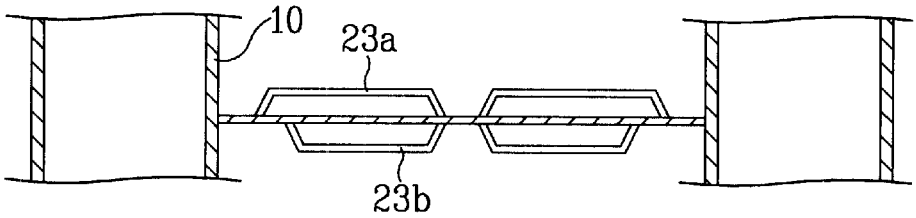
FIG.2B Related Art
Figure 3:
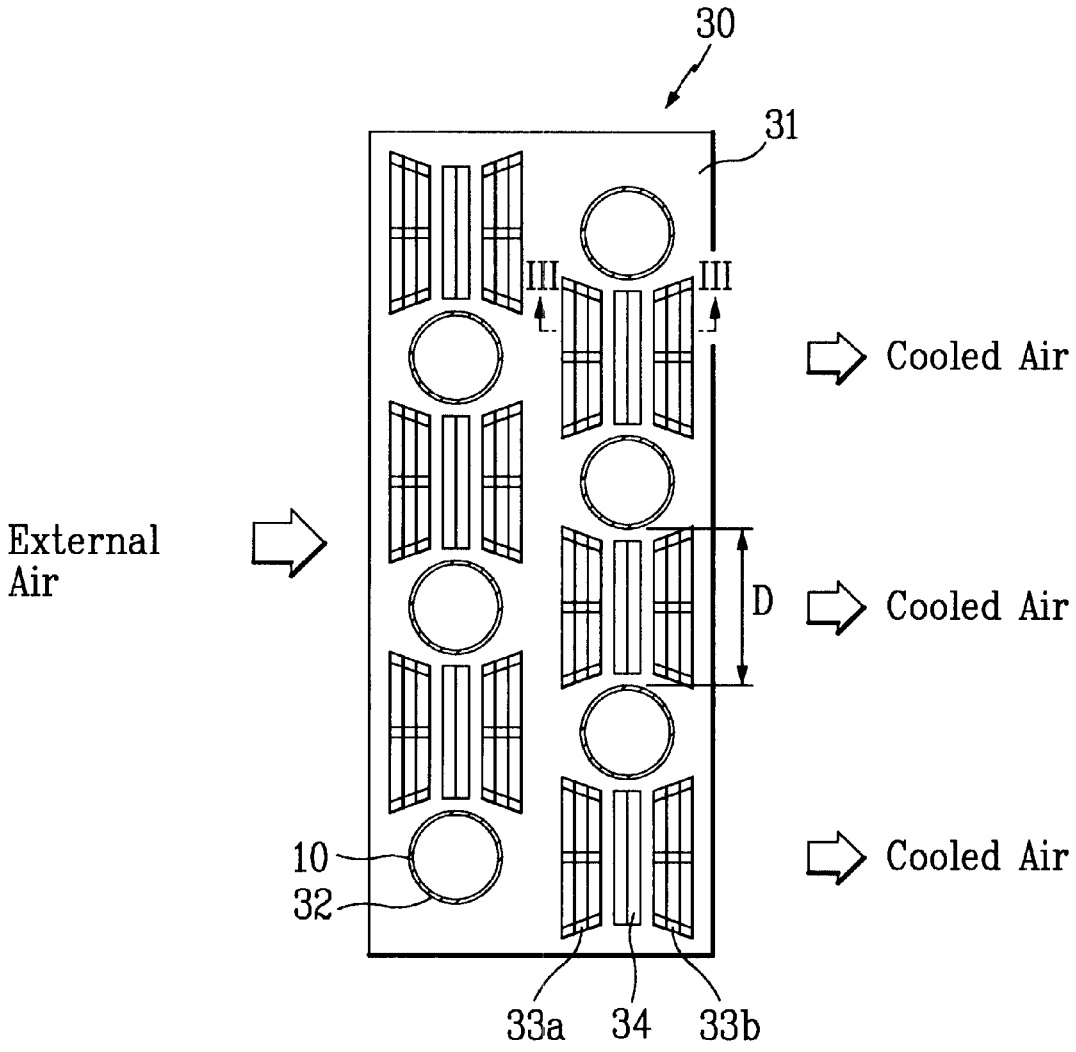
FIG. 3 illustrates a section of a portion of an evaporator in an air conditioner in accordance with a preferred embodiment of the present invention.

Reference will now be made in detail to the preferred embodiments of the present invention, examples of which are illustrated in the accompanying drawings. In explanation of the present invention, identical part will be given the same name and reference symbols, and explanations for which will be omitted. FIG. 3 illustrates a section of a portion of an evaporator in an air conditioner in accordance with a preferred embodiment of the present invention. Since a shape and an arrangement of the tubes are identical to FIG. 1, a detailed explanation for which will be omitted. The fin will be explained in detail.

Referring to FIG. 3, the fin 30 in the evaporator in accordance with a preferred embodiment of the present invention includes a plurality of collars 32, a plurality of slits 33 between the collars 32, and drain means 34 of a fixed form, in a metallic base plate 31, a body of the fin 30. As explained with reference to FIG. 1, the collars 32 are arranged in two columns of a first column and a second column along a direction of advance of the air, with the collars 32 in each of the columns arranged in zigzag over the entire base plate 31. And, the slits 33 form a slit group between adjacent collars 32. In more detail, the slits 33 form a forward slit group 34*a* and a backward slip group 34*b* for an air inflow direction centered on the drain means 34. And, as explained, an upper slit and a lower slit are formed alternatively with reference to the base plate 31 within respective slit groups 34*a* and 34*b* for making a uniform heat exchange in overall. In the evaporator of the present invention, the shape and arrangement of the slits 33 may differ depending on conditions of use, and the evaporator in FIG. 3 is one of many variations of the slits 33 with respect to the shape and arrangement thereof.

Figure 4A:
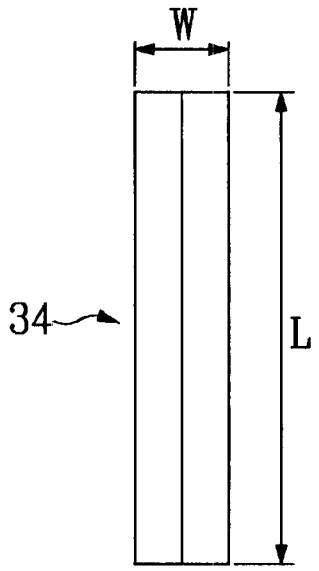
FIG. 4A illustrates drain means of the present invention, schematically.
Figure 4B:
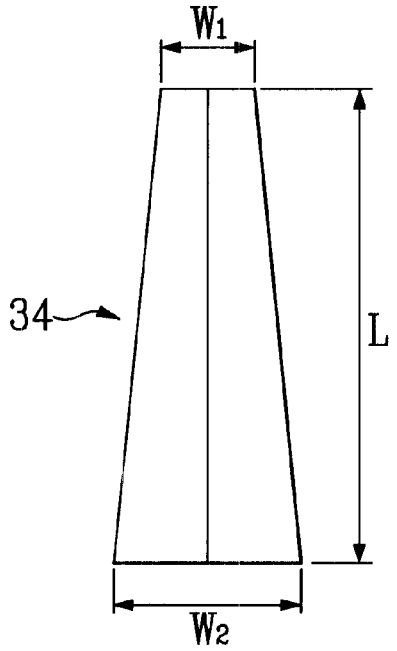
FIG. 4B illustrates a variation of the drain means in FIG. 4A, schematically.
Figure 5A:
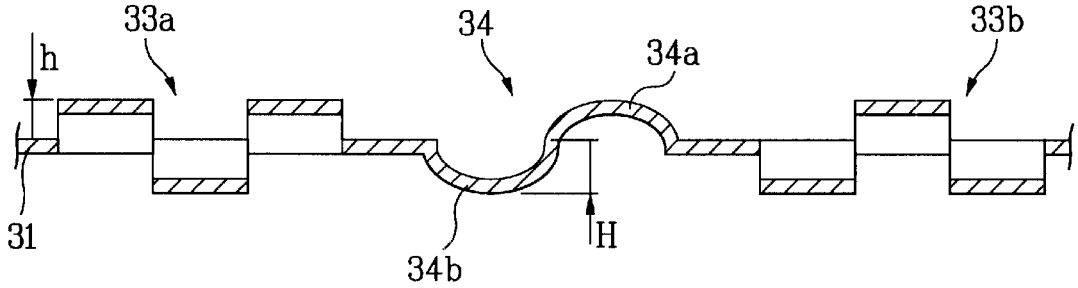
FIG. 5A illustrates a section of the drain means of the present invention in FIG. 3 across line III—III.
Figure 5B:
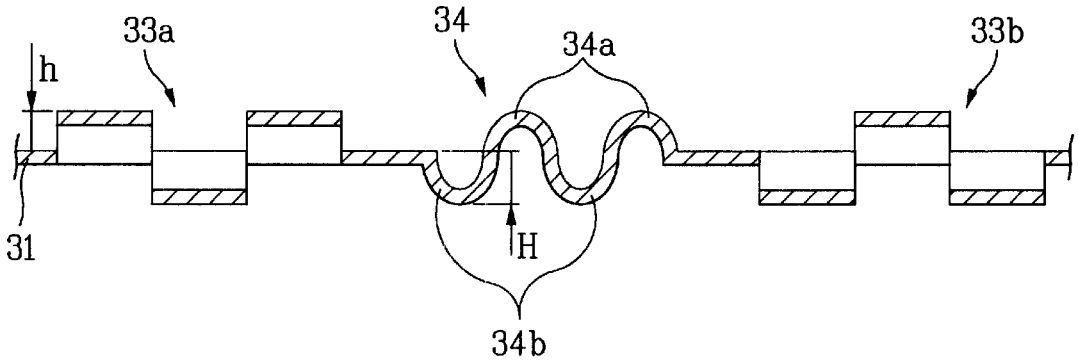
FIG. 5B illustrates a variation of the drain means in FIG. 5A, schematically.

Under the foregoing basic system, the drain means 34 is formed in an intermediate region existing between the collars 32 in each column, and in, more detail, in a central portion of the intermediate region. Such drain means is shown in FIGS. 4A~5A, referring to which the drain means will be explained, in detail. In the fin-tube type evaporator of the present invention, the drain means 34 is preferably grooves each with a fixed width/a fixed length for easy formation. The width and length of the drain means 34 are determined according to shapes and sizes of the collars 32 and the slits 33, appropriately. As shown in FIG. 4A, in a most general shape of the drain means 34, the drain means 34 may have a fixed width 'W' over an entire length 'L' of the drain means 34. As shown in FIG. 4B which shows a variation of the drain means 34, it is preferable that the drain means 34 has a width 'W' which is increased gradually as the length 'L' of the drain means 34 is increased. That is, in the drain means 3, a lower end width W2 is formed greater than an upper end width W1. Accordingly, the drain means 34 can drain the condensed water more smoothly. And, as explained before, though the length 'L' of the drain means 34 may be determined appropriately, it is preferable that the length is actually determined to be identical to a distance 'D' between adjacent collars 32 within the same column, which is a length of the intermediate region. Such a length 'L' of the drain means 34 is favorable for direct drain of the condensed water formed on the tube 10. And, the drain means 34 preferably has a symmetric convex/concave section for uniform drain of condensed water both from an upper surface and a lower surface of the fin 30. According to this, as shown in FIG. 5A, the section of the drain means 34 may have one pair of symmetric portions, substantially of one peak portion 34*a* and one bottom portion 34*b*. Preferably, as shown in FIG. 5B, the section of the drain means 34 has a plurality of symmetric portions, i.e., a plurality of peak portions 34*a* and bottom portions 34*b*. Since such sections dispersed and drained, a drain capability of the drain means 34 is enhanced. It is preferable that heights of the symmetric portions, i.e., heights 'H' of the peak portion 34*a* and the bottom portion 34*b* is lower than heights 'h' of the forward or backward slit groups 33*a* or 33*b*. If the heights 'H' of the symmetric portions 34*a* and 34*b* are higher than the heights 'h' of the slit groups 33*a* and 33*b*, a flow resistance greater than initially set value is occurred. Such a setting of the height 'H' of the symmetric portions prevents occurrence of the flow resistance caused by formation of the drain means.

Figure 6:
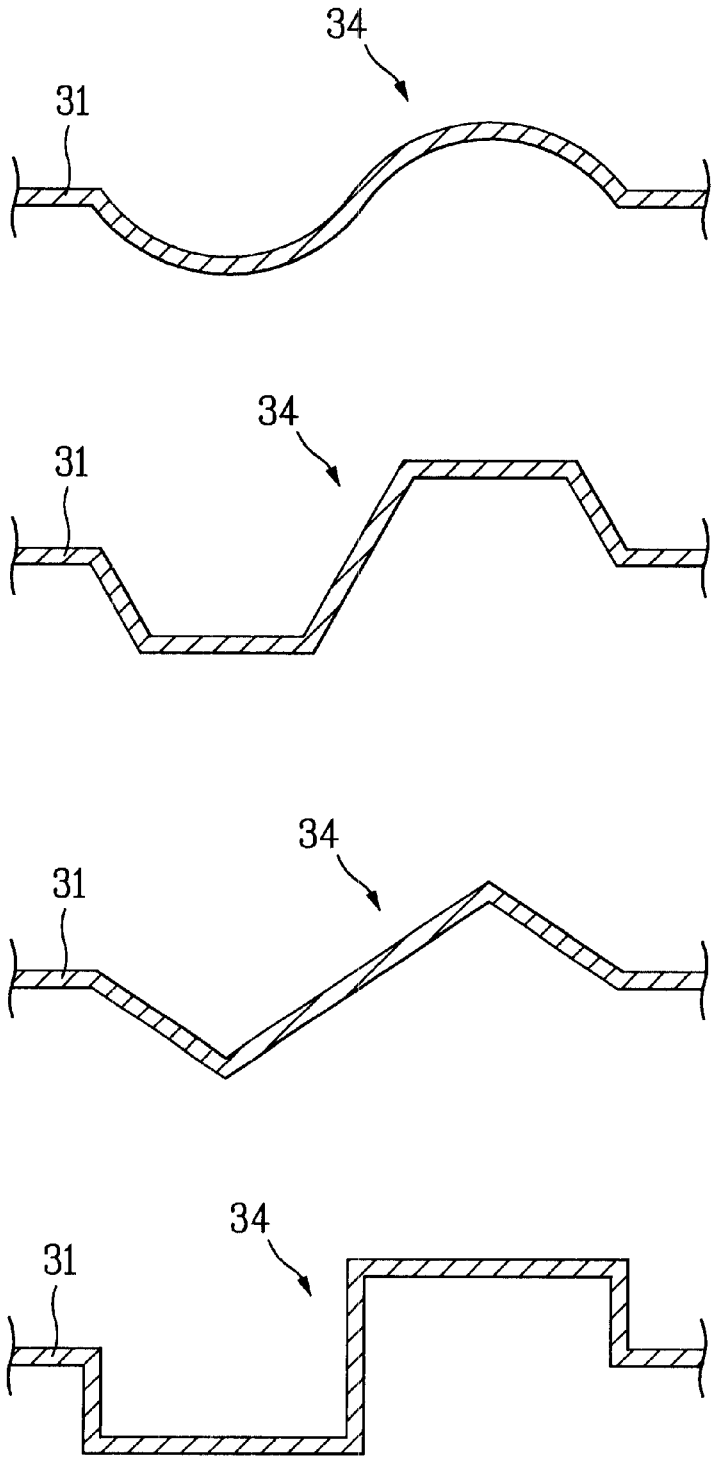
FIG. 6 illustrates sections of various forms of symmetric portions of drain means, schematically; and, FIGS. 7A and 7B illustrate variations of a fin structure in an evaporator of the present invention.

In the meantime, as shown in FIG. 6, the section of the drain means 34 may be semicircular, trapezoidal, triangular, or rectangular, of which semicircular section is applied to the drain means shown in FIGS. 5A and 5B.

On the whole, the fin-tube type evaporator in an air conditioner of the present invention has a condensed water drain capability improved by the drain means 34. The operation of the evaporator of the present invention will be explained.

Upon putting the air conditioner into operation, high pressure, and high temperature refrigerant from a compressor circulates through the tube 10 in the evaporator, and, on the same time, room air is blown into the evaporator, more precisely, between the fins 30 in the evaporator by a blower in the air conditioner. An heat exchange is made between the evaporator and the air passing through the evaporator, to cool down the air by a heat absorption caused by the heat exchange, which is then returned to a room. As explained, the heat exchange is occurred at the entire evaporator, i.e., both at the fins 30 and the tubes 10, wherein the fin 30 provided with a large heat absorption area enhances a heat exchange efficiency. And, the slit groups 33 increase an area the fins 30 are brought into contact with the air, for improving the heat exchange efficiency. During operation of the air conditioner, the condensed water is formed on the surface of the evaporator continuously by cooled moist in the air, flows on the surface of the evaporator upon collected to a certain amount. First, a portion of the condensed water formed on a surface of the fin 30, even if it is a small amount, is collected to the drain means 34 between the collars 32, and flows down. And, since the drain means 34 is formed at a central portion of adjacent collars 32, and to be in communication with the collars 32 if required, most of the condensed water formed on a surface of the tubes 10 flows along the drain means 34. In this instance, the condensed water on an upper portion of the evaporator flows down along the drain means 34 through circumferences of the tubes 10 on the same column, and induces the condensed water on surfaces of the lower tubes to flow along the drain means 34, smoothly. In the foregoing series of drain steps, since the condensed water is formed at the tube 10 in which the refrigerant flows directly more than the fin 30 surface, the drain means 34 between the tubes 10 can drain much condensed water, effectively. As explained, since the evaporator of the present invention has a substantially enhanced drain capability, an amount of the condensed water remained on a surface of the evaporator, i.e., a surface of the tubes 10 and fins 30 when the air conditioner is in operation is reduced significantly. According to this, the flow resistance and the pressure loss of the air cooled down at the evaporator are reduced, and drain of an excessive condensed water out of the air conditioner is prevented.

Figure 7A:
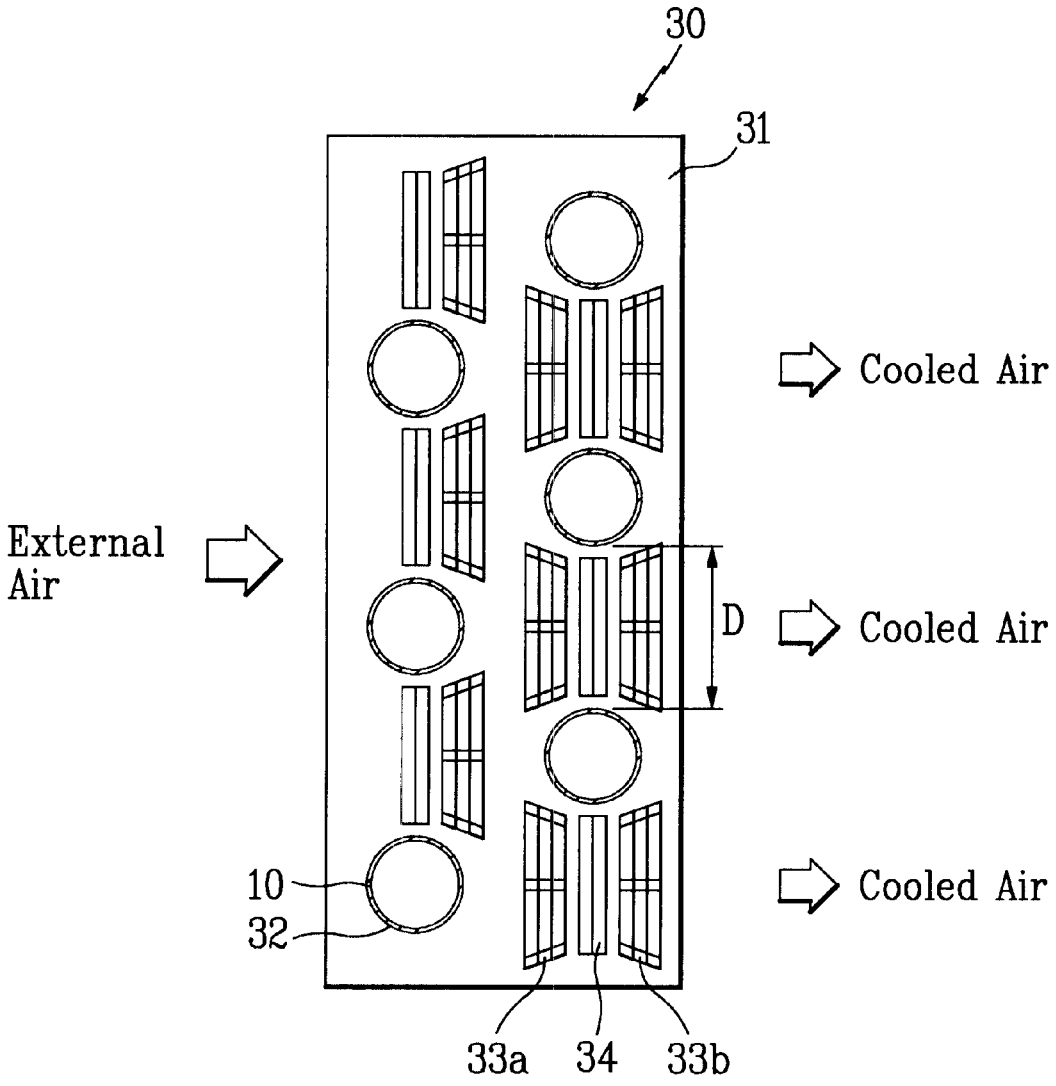
Figure 7B:
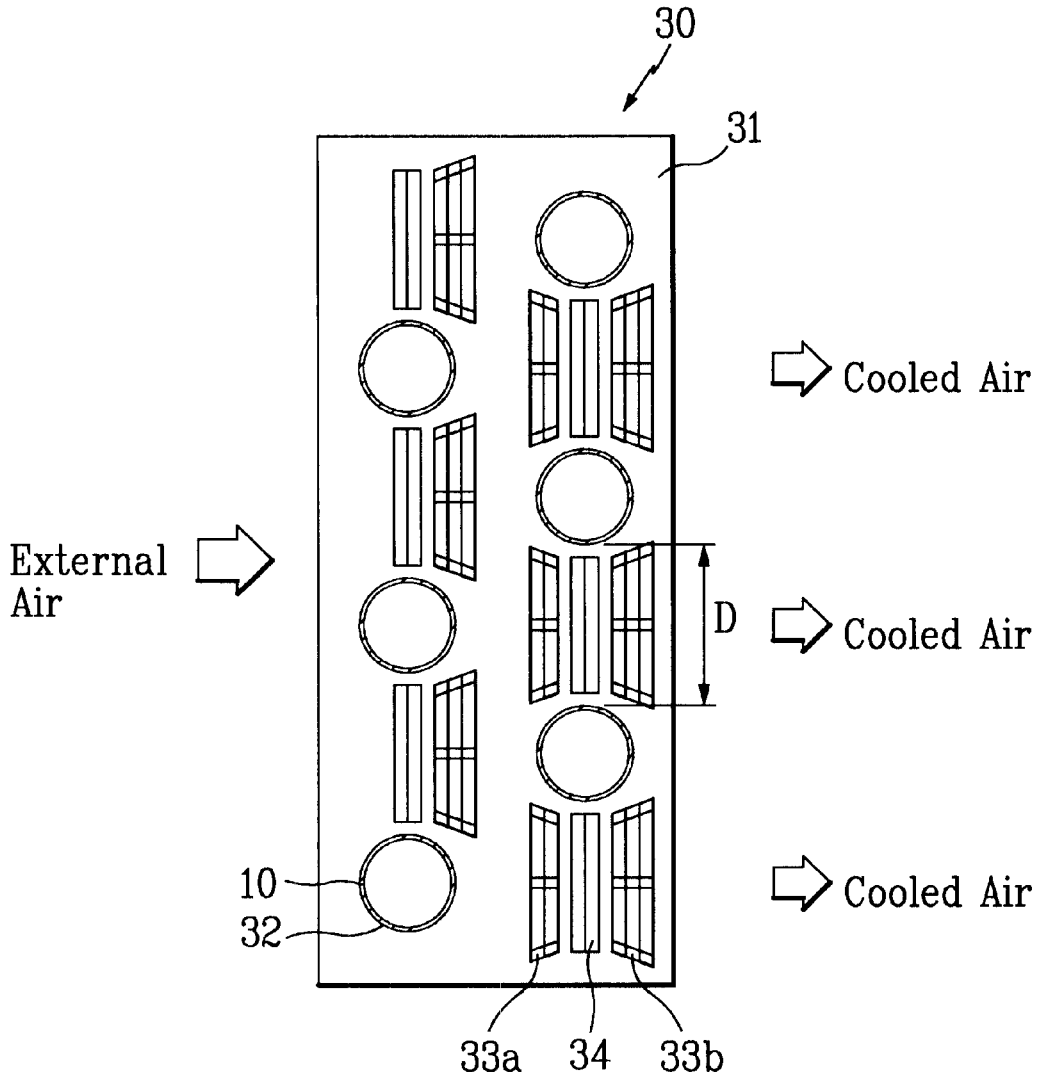

In the meantime, there can be structural variations of the evaporator of the present invention for improving an air cooling performance. FIGS. 7A and 7B illustrate structural variations of the fins. As shown in FIG. 7A, in the evaporator of the present invention, the fin 30 may only have the backward slit groups 33*b* with reference to the drain means 34 in the first column. And, in the variation shown in FIG. 7B, the forward slit groups 33*a* in the second column are simplified, together with the first column which has a structure identical to a structure shown in FIG. 7A. Even though there is almost no reduction of an overall heat exchange amount in the forgoing variations, the reduction of a number of slits substantially reduces the air flow resistance. In the evaporator, when the first column the air is introduced thereto and the second column the air is discharged therefrom are compared, the heat exchange is made at the first column more than the second column. In other words, the air is involved in a temperature drop at the first column greater than at the second column due to a greater temperature difference between the air and the surface of the evaporator. Accordingly, there is an excessive condensed water formation at the first column, which causes an external leakage of the condensed water and the increased flow resistance of the air. However, in the foregoing variation, either by eliminating forward slit groups 33*a* or by reducing a concentration of the slits, the heat exchange of the evaporator can be made uniform throughout the first and second columns. Therefore, by inhibiting the formation of the excessive condensed water at the first column, the external leakage of the condensed water and the increase of the flow resistance can be prevented.

Thus, the fin tube type evaporator in an air conditioner of the present invention can reduce a flow resistance and a pressure loss of an introduced air because the drain of the condensed water is made easy by the drain means 34, that reduces both a noise from the evaporator and a load on the blower. And, the leakage of excessive condensed water out of the air conditioner carried on the air can be prevented because the drain capability is improved.

It will be apparent to those skilled in the art that various modifications and variations can be made in the fin tube type evaporator in an air conditioner of the present invention without departing from the spirit or scope of the invention. Thus, it is intended that the present invention cover the modifications and variations of this invention provided they come within the scope of the appended claims and their equivalents.

What is claimed is:

1. A fin tube type evaporator in an air conditioner, comprising:

tubes for flow of a refrigerant therethrough;

fins each in the form of a substantially planar plate, and having a plurality of collars for coupling with the tubes and a plurality of slits formed in the plate between the collars; and drain means of a predetermined form being formed in an intermediate region in the plate between the collars, wherein the evaporator drains condensed water therein smoothly with the drain means.

2. The fin tube type evaporator as claimed in claim 1, wherein the drain means is grooves each with fixed width and a fixed length having symmetric convex/concave sections.

3. The fin tube type evaporator as claimed in claim 2, wherein the width of the drain means is fixed throughout the length of an entire drain means.

4. The fin tube type evaporator as claimed in claim 3, wherein the width of the drain means increases gradually along the length of the drain means.

5. The fin tube type evaporator as claimed in claim 2, wherein the length of the drain means is the same as a distance between adjacent collars in the fin.

6. The fin tube type evaporator as claimed in claim 2, wherein a section of the drain means includes a pair of symmetric portions of one peak portion and a bottom portion.

7. The fin tube type evaporator as claimed in claim 6, wherein the section of the drain means includes a plurality of symmetric portions.

8. The fin tube type evaporator as claimed in claim 6, wherein the symmetric portion has a height lower than a height of a corresponding slit.

9. The fin tube type evaporator as claimed in claim 6, wherein a section of the symmetric portion is a circular arc, trapezoidal, triangular, or rectangular.

10. A fin tube type evaporator in an air conditioner, comprising:

tubes configured for flow of a refrigerant therethrough;

fins each in the form of a substantially planar plate and having a plurality of collars for coupling with the tubes, and a plurality of slits formed in the plate between the collars; and at least one drain groove of a predetermined form formed in an intermediate region in the plate between the collars, wherein the evaporator drains condensed water therein smoothly via the at least one drain groove.

11. The fin tube type evaporator as claimed in claim 1, wherein the width of the at least one drain groove is fixed throughout the length of the entire drain groove.

12. The fin tube type evaporator as claimed in claim 11, wherein the width of the at least one drain groove increases gradually along the length of the drain groove.

13. The fin tube type evaporator as claimed in claim 10, wherein the at least one drain groove has a fixed width and a fixed length having symmetric convex and/or concave sections.

14. The fin tube type evaporator as claimed in claim 13, wherein the length of the at least one drain groove is the same as a distance between adjacent collars in the fin.

15. The fin tube type evaporator as claimed in claim 13, wherein a section of the at least one drain groove includes a pair of symmetric portions of one peak portion and a bottom portion.

16. The fin tube type evaporator as claimed in claim 15, wherein the section of the at least one drain groove includes a plurality of symmetric portions.

17. The fin tube type evaporator as claimed in claim 15, wherein the symmetric portion has a height lower than a height of a corresponding slit.

18. The fin tube type evaporator as claimed in claim 15, wherein a section of the symmetric portion is a circular arc, trapezoidal, triangular, or rectangular.

* * * * *